US005631549A

United States Patent [19]

Hong

[11] Patent Number: 5,631,549

[45] Date of Patent: May 20, 1997

[54] LINEAR REGULATOR POWER SUPPLY WITH AN OVERCURRENT PROTECTION DEVICE

[75] Inventor: Jae-Gyoo Hong, Seoul, Rep. of Korea

[73] Assignee: Daewoo Electronics Co. Ltd., Seoul, Rep. of Korea

[21] Appl. No.: 393,300

[22] Filed: Feb. 23, 1995

[30] Foreign Application Priority Data

May 31, 1994 [KR] Rep. of Korea ..... 94-12062

[51] Int. Cl.[6] ..... G05F 1/573

[52] U.S. Cl. ..... 323/277; 323/276

[58] Field of Search ..... 323/276, 277, 323/234, 265; 363/50; 361/18, 56, 91, 100

[56] References Cited

U.S. PATENT DOCUMENTS 3,736,469 5/1973 Baugher et al. ..... 317/22
4,428,015 1/1984 Nesler ..... 361/18
4,855,855 8/1989 Boertzel et al. ..... 361/18
5,023,542 6/1991 Banura ..... 323/284
5,499,154 3/1996 Cullison ..... 361/18

*Primary Examiner*—Peter S. Wong
*Assistant Examiner*—Adolf Berhane
*Attorney, Agent, or Firm*—Anderson Kill & Olick P.C.

[57] ABSTRACT

An improved regulator apparatus comprises a regulation unit, in response to an operation signal, for regulating an input voltage to provide a regulated voltage to its dependent load and an overcurrent protection unit for blocking the operation of the regulation unit when a short-circuiting occurs in the load. The overcurrent protection unit includes a bypass transistor for bypassing the operation signal to the regulation unit and a diode for sensing the change in the potential level of the regulated voltage to activate the bypass transistor.

3 Claims, 1 Drawing Sheet

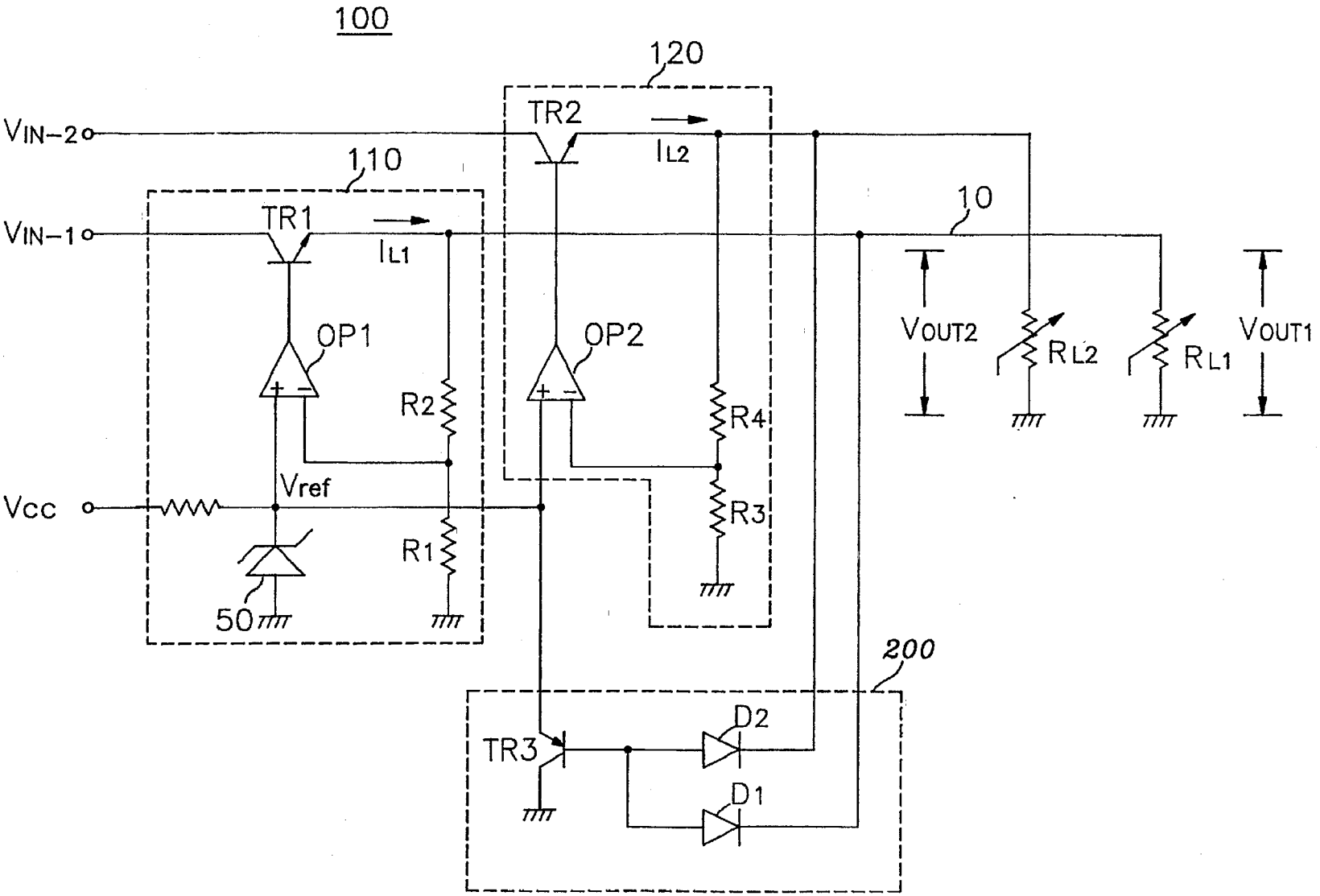
100
110
120
200
10
VOUT1
VOUT2
RL1
RL2
IL1
IL2
TR1
TR2
TR3
OP1
OP2
R1
R2
R3
R4
D1
D2
Vref
50
VIN-2
VIN-1
Vcc

LINEAR REGULATOR POWER SUPPLY WITH AN OVERCURRENT PROTECTION DEVICE

FIELD OF THE INVENTION

The present invention relates to a linear regulator power supply and, more particularly, to an improved linear regulator power supply provided with an overcurrent protection device.

BACKGROUND OF THE INVENTION

A circuit capable of converting an available ac voltage to a dc voltage is known as a dc power supply. The dc power supply has a rectifier type circuitry. One of the drawbacks in a conventional rectifier circuitry is that the converted dc voltage includes some ac ripple voltages, thereby hampering the rectifier's ability to deliver a pure dc voltage. In addition, the converted dc voltage may be reduced as more load currents are drawn, thereby causing an unevenness in the power supply voltage. In order to minimize such variations, a linear regulator power supply is normally used. The linear regulator power supply conventionally includes an operational amplifier (hereinafter referred to as an "op amp").

During a normal operation of the linear regulator power supply, a short-circuiting may occur in its dependent load resulting in an abrupt overcurrent passing therethrough, which may cause a breakage thereof.

In order to provide a protection against such an occurrence, a fuse system is normally used in the linear regulator power supply to decouple the overcurrent. However, one of the major short-comings in this approach is that the fuse must be exchanged or reinstated each time the short-circuiting occurs.

SUMMARY OF THE INVENTION

It is, therefore, a primary object of the invention to provide a reliable linear regulator power supply having a protective device for preventing an overcurrent due to a short-circuiting.

In accordance with the present invention, there is provided an improved regulator apparatus comprising a regulation unit, responsive to an operation signal, for regulating an input voltage thereto to provide a regulated voltage to a dependent load; and an overcurrent protection unit for stopping the operation of the regulation unit when an abrupt change in the potential level of the regulated voltage occurs in the load. The overcurrent protection unit includes a bypass transistor for controlling the transmission of the operation signal to the regulation unit, and a diode for sensing a change in the potential level of the regulated voltage to thereby activate the bypass transistor.

BRIEF DESCRIPTION OF THE DRAWING

The above and other objects and features of the present invention will become apparent from the following description of preferred embodiments taken in conjunction with the accompanying drawing, which is a circuit diagram of an linear regulator power supply having a protection device for preventing an overcurrent.

DETAILED DESCRIPTION OF THE PREFERRED EMBODIMENTS

Referring to the drawing, there is shown a circuit diagram of a multi-stage linear regulator power supply 100 in accordance with the invention.

The linear regulator power supply 100 comprises a pair of regulation units 110, 120 with their corresponding dependent loads $R_{L1}$, $R_{L2}$, and a protection circuit 200 for preventing an overcurrent due to a short-circuit in any of the loads. The first regulation unit 110 includes an op amp OP1, a zener diode 50 and a boost transistor TR1. A voltage divider with a pair of resistors $R_1$ and $R_2$ is connected to an inverting input terminal (–) of the op amp OP1. A voltage drop $V_{R1}$ across the resistor $R_1$ is applied as a comparison voltage to the inverting input terminal (–) of the op amp OP1. The zener diode 50 is connected to a non-inverting input terminal (+) of the op amp OP1 and provides a reference voltage $V_{ref}$ to the non-inverting input terminal (+).

The op amp OP1, using the difference between the reference voltage $V_{ref}$ and the comparison voltage $V_{R1}$, provides a switching signal to the boost transistor TR1. In response to the switching signal, the transistor TR1 is turned on, to thereby allow a regulated voltage to be applied to the load $R_{L1}$ by controlling a load current $I_{L1}$ therethrough.

With the arrangement as set forth above, the regulated voltage $V_{out1}$ across the load $R_{L1}$ may be represented as follows.

$$V_{out1} = V_{R1} + V_{R2} = V_{ref} + \frac{R_2}{R_1} V_{ref} = V_{ref}\left(1 + \frac{R_2}{R_1}\right)$$

wherein $V_{R2}$ is a voltage drop across the resistor $R_2$.

Like the first regulation unit 110, the second regulation unit 120 includes an op amp OP2 and a boost transistor TR2. A voltage divider with a pair of resistors $R_3$ and $R_4$ is connected to an inverting input terminal (–) of the op amp OP2. A voltage drop $V_{R3}$ across the resistor $R_3$ is applied as a comparison voltage to the inverting input terminal (–) of the op amp OP2. A non-inverting input terminal (+) of the op amp OP1 is commonly connected to the output of the zener diode 50 which provides the reference voltage $V_{ref}$ thereto.

The op amp OP2, using the difference between the reference voltage $V_{ref}$ and the comparison voltage $V_{R3}$, provides a switching signal to the boost transistor TR2. In response to the switching signal, the transistor TR2 is turned on, thereby allowing a regulated voltage to be applied to load $R_{L2}$ by controlling a load current $I_{L2}$ therethrough.

With the arrangement as set forth above, the regulated voltage $V_{out2}$ across the load $R_{L2}$ can be represented as follows.

$$V_{out2} = V_{R3} + V_{R4} = V_{ref} + \frac{R_4}{R_3} V_{ref} = V_{ref}\left(1 + \frac{R_4}{R_3}\right)$$

wherein $V_{R4}$ is a voltage drop across the resistor $R_4$.

The protection circuit 200 has a bypass transistor TR3 and a pair of diodes D1 and D2 coupled to the first and the second regulation units 110 and 120, respectively. The bypass transistor TR3 serves to control the flow of the switching signal to the transistors TR1 and TR2 and has an emitter connected to the non-inverting input terminals (+) of the op amps OP1 and OP2, a collector connected to ground, and a base connected to each anode of the diodes D1 and D2. Cathodes of the diodes D1 and D2 are connected to emitters of the transistor TR1 and TR2, respectively. Each of the diodes D1 and D2 detects a change in the potential level of the respective regulated output voltage to activate the bypass transistor TR3. Under a normal operation of the linear regulator power supply 100, the potential level of the regulated output voltage remains higher than that of the base of the bypass transistor TR3, and therefore, the protection circuit 200 remains inoperative.

During the operation of the linear regulator power supply 100, when a short-circuiting occurs in any of the load, e.g., $R_{L1}$, an abrupt overcurrent is induced to pass through the regulation unit 110, thereby lowering the potential level of the output voltage below that of the base voltage of the transistor TR3. As a result of the drop in the potential level of the output voltage, the diode D1 becomes forward biased and the bypass transistor TR3 is turned on. When the potential level of the reference voltage $V_{ref}$ becomes equal to the ground level through the bypass transistor TR3, the op amp OP1 becomes inactive and the boost transistor TRt is turned off to thereby stop the flow of the abrupt overcurrent through the regulation unit 110.

Similarly, an overcurrent protection with respective to the second regulation unit 120 is accomplished through the use of the protection circuit 200 as set forth above.

Another diode may be additionally connected, in parallel, to the diodes D1 and D2 with the addition of a regulation unit to the linear regulator power supply 100.

While the present invention has been shown and described with reference to the particular embodiments, it will be apparent to those skilled in the art that many changes and modifications may be made without departing from the spirit and scope of the invention as defined in the appended claims.

What is claimed is:

1. A linear regulator power supply comprising:

a plurality of regulation units, each of the regulation units having a switching transistor for providing a regulated voltage to a load connected to an output terminal thereof, means for producing a reference voltage and an operational amplifier for generating a switching signal to activate the switching transistor using a difference between the reference voltage and a comparison voltage; and means, connected between the load and the operational amplifier, for coupling the reference voltage to ground when there is a drop in the potential level of the regulated voltage due to a short circuiting occurred on the load, thereby making the operational amplifier inactive and the switching transistor inoperable.

2. The linear regulator power supply of claim 1, wherein the coupling means includes a bypass transistor being turned-on in accordance with the drop in the potential level, the bypass transistor having a base connected to the output terminal, an emitter connected to the reference voltage providing means and a collector connected to ground.

3. The linear regulator power supply of claim 2, further comprising a parallel circuitry having a plurality of diodes, each of the diodes being connected between the base of the bypass transistor and the load and being forward biased by the drop in the potential level of the regulated voltage to connect the drop in the potential level to the base of the bypass transistor.

* * * * *